US005185980A

United States Patent [19]

Rydberg et al.

[11] Patent Number: 5,185,980

[45] Date of Patent: Feb. 16, 1993

[54] WALL EXPOSED TO WEAR AND MEANS FOR MAKING IT

[75] Inventors: Bo L. Rydberg; Bengt L. A. Dehlén, both of Trelleborg, Sweden

[73] Assignee: Trellex Aktiebolag, Trelleborg, Sweden

[21] Appl. No.: 667,312

[22] Filed: Mar. 12, 1991

[30] Foreign Application Priority Data

Mar. 13, 1990 [SE] Sweden ..... 9000905

[51] Int. Cl.[5] ..... E04B 1/38

[52] U.S. Cl. ..... 52/506; 296/39.2

[58] Field of Search ..... 52/309.2, 795; 105/423; 296/39.1, 39.2, 39.3

[56] References Cited

U.S. PATENT DOCUMENTS

| | | | |
|---|---|---|---|
| Re. 32,198 | 7/1986 | Wayne . | |
| 1,591,938 | 7/1926 | Harrison . | |
| 2,791,463 | 5/1957 | Levitt | 105/423 |
| 3,194,506 | 7/1965 | Bourne et al. . | |
| 3,199,261 | 8/1965 | Soddy | 296/39.3 |
| 3,350,832 | 11/1967 | Persson . | |
| 3,934,828 | 1/1976 | Persson . | |
| 3,949,943 | 4/1976 | Schuler et al. . | |
| 3,953,950 | 5/1976 | Sudyk | 52/506 |
| 4,047,749 | 9/1977 | Lambitz | 296/39.2 |
| 4,162,098 | 7/1979 | Richardson | 296/39.2 |
| 4,341,412 | 7/1982 | Wayne | 296/39.2 |
| 4,653,246 | 3/1987 | Hepler | 52/309.2 |
| 4,693,507 | 9/1987 | Dresen | 296/39.2 |
| 4,791,765 | 12/1988 | Noggle | 52/787 |
| 4,974,895 | 12/1990 | Davenport | 296/39.2 |

FOREIGN PATENT DOCUMENTS

| | | |
|---|---|---|
| 254048 | 5/1967 | Austria . |
| 122370 | 2/1972 | Denmark . |
| 1482420 | 5/1969 | Fed. Rep. of Germany . |
| 580984 | 10/1976 | Switzerland . |

*Primary Examiner*—David A. Scherbel
*Assistant Examiner*—Creighton Smith
*Attorney, Agent, or Firm*—Beveridge, DeGrandi, Weilacher & Young

[57] ABSTRACT

A wall exposed to wear is made up of wear-resisting, impact-absorbing elements (11) and a structure (10, 12, 13) supporting these elements. The elements (11) are elongate and have base portions (15) to permit mounting the elements on the supporting structure, and arch portions (19) of elastomer or plastic material which extend freely between the base portions and directly pass into a protective layer over the base portions. The thickness of the arch portions amounts to 50% at most, preferably about 30–50% of the total thickness of the element, which preferably is at least about 10 cm.

19 Claims, 3 Drawing Sheets

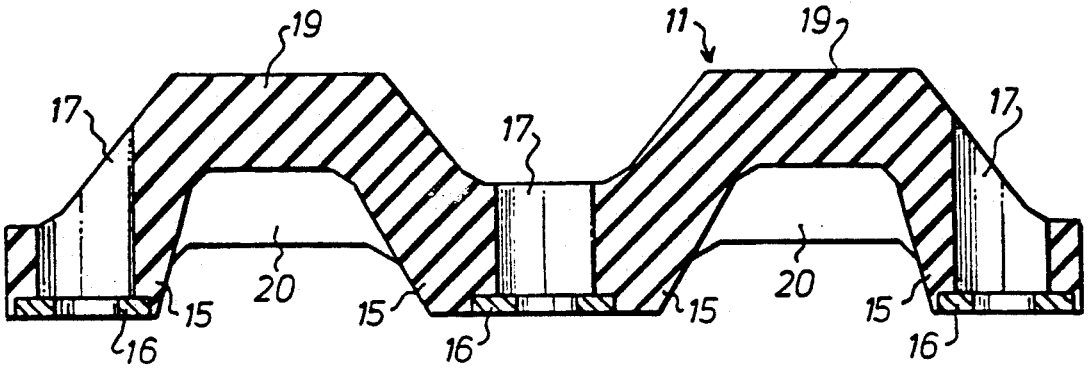
FIG. 3
FIG. 4
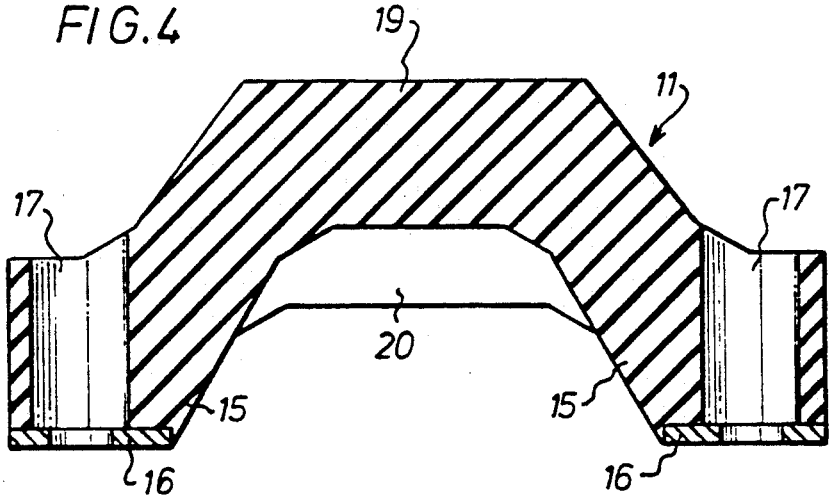

WALL EXPOSED TO WEAR AND MEANS FOR MAKING IT

The present invention relates to a wall exposed to wear, which is made up of wear-resisting, impact-absorbing elements and a structure supporting said elements which comprise a wear-resisting, impact-absorbing layer of an elastomer or plastic material. The invention also relates to means for making such a wall.

Walls of this type can be used as wall panels in mill drums, skips, chutes, and as load-bearing surfaces, which when charged with material, often being large-size pieces of ore or stone, are subjected to heavy impacts and to wear or abrasion. To protect such walls, these are often equipped with a wear-resistant layer of elastomer or plastic material directly engaging the supporting structure or suspended 'hammockwise" to increase the flexibility of the material and to prevent breakage of the surface layer. An example of this prior art technique is disclosed in U.S. Pat. No. 3,350,832. This document describes a wall construction comprising wall panels and retainer elements. The main portion of the wall panels consists of rubber or plastic and is provided on its underside with protruding metal plates. The retainer elements are pressed against these metal plates so as to hold the wall panels clamped against the supporting structure. Another example of this known technology is disclosed in DE-A-1,482,420 (and the counterpart AT-C-254,048 and DK-B-122,370), where the wall panels have projecting flanges consisting of the same material as the rest of the wall panels, viz. rubber or plastic material. As in U.S. Pat. No. 3,350,832, the wall panels are urged into tight engagement against the supporting structure by means of retainer elements fixed by screws. In one embodiment, the wall panels are designed with weight-reducing recesses on their side facing the supporting structure.

CH-A-580,984 discloses a lining in a ball mill. This lining also comprises wall panels of rubber or plastic and retainer elements, also serving as lifters. The lifters are partially recessed in the wall panels. To increase the clamping pressure in the boundary surface between the lifters and the wall panels, these have been designed, in one embodiment thereof, with recesses in their side facing the supporting structure.

A further example of the prior art technique is disclosed in U.S. Pat. No. 3,194,506. This document describes a mill liner in which rod-like liner members of metal are anchored in a form-fitting way by means of elastically compressible rubber rods disposed between the liner members.

As mentioned above, attempts have also been made to increase the energy-absorbing ability of a wall exposed to wear and impacts, by designing it as a hammock-suspended construction. One example of this technique is disclosed in U.S. Pat. No. 3,934,828. This document describes wall segments or panels designed as inflatable elements. Optional lifters have been integrally formed with or anchored in the wall panels.

All of these prior art wall designs suffer from a number of drawbacks which the present invention aims at overcoming or reducing.

One object of the invention is to provide a wall which is made up of wear-resisting, impact-absorbing elements and which, despite being fixedly mounted on its supporting structure, has the required energy-absorbing ability and high impact resistance.

Other objects of the invention will be apparent from the following text.

According to the invention, the required energy-absorbing ability is achieved in that the wear-resisting, impact-absorbing elements are elongate and comprise spaced-apart base portions to permit mounting the elements on the supporting structure, and arch portions consisting of said wear-resistant elastomer or plastic material and extending freely between said base portions, and in that this elastomer or plastic material also extends throughout the base portions. By thus designing the wall elements, the arch portions thereof will act as rubber springs and, while being resiliently deflected, absorb the energy of pieces of ore or stone hitting the wall. By the arch shape of the wall elements, the major part of the kinetic energy of the pieces of ore or stone will have been absorbed by the elastic deformation of the arch portions before this deformation has progressed to such an extent that the arch portions are caused to engage the subjacent supporting structure.

Arch-shaped wall panels in a wear-resistant lining are known from U.S. Pat. No. 3,949,943. In this prior art construction, use is however made of cast metal plates or panels of a wear-resistant material. These metal plates are held clamped against the supporting structure in that their opposing edges have been formed with angular recesses and in that retainer elements of complementary shape have been disposed between the wall panels. This arrangement provides a form-fitting interconnection of the lining elements after mounting. In this respect, this prior art construction resembles that disclosed in the above-mentioned U.S. Pat. No. 3,194,506. In U.S. Pat. No. 3,949,943, the joints between the wall panels and the retainer elements have been arranged in a manner to ensure that a wall panel will not become loose in case it should fracture from impacts or shocks. In fact, if the wall panel should become loose, the entire lining would also become loose. The arch shape of these metal wall panels is however not utilised for the same purpose as in the present invention, relying on an elastic deformation or deflection of the valve portions to increase the energy-absorbing ability of the wall. This is however not possible when using rigid metal elements. The same applies to the arch-shaped metal elements shown and described in U.S. Pat. No. 1,591,938.

The invention also relates to means for making such a wall, which means comprises elements of the design described above.

The invention will be described in more detail hereinbelow with reference to the accompanying drawings showing two embodiments of the invention.

FIG. 3 is a sectional view showing an embodiment of a wear-resisting, impact-absorbing element according to the invention.

FIG. 4 is a cross-sectional view showing another embodiment of a wear-resisting, impact-absorbing element according to the invention.

Figure 1:
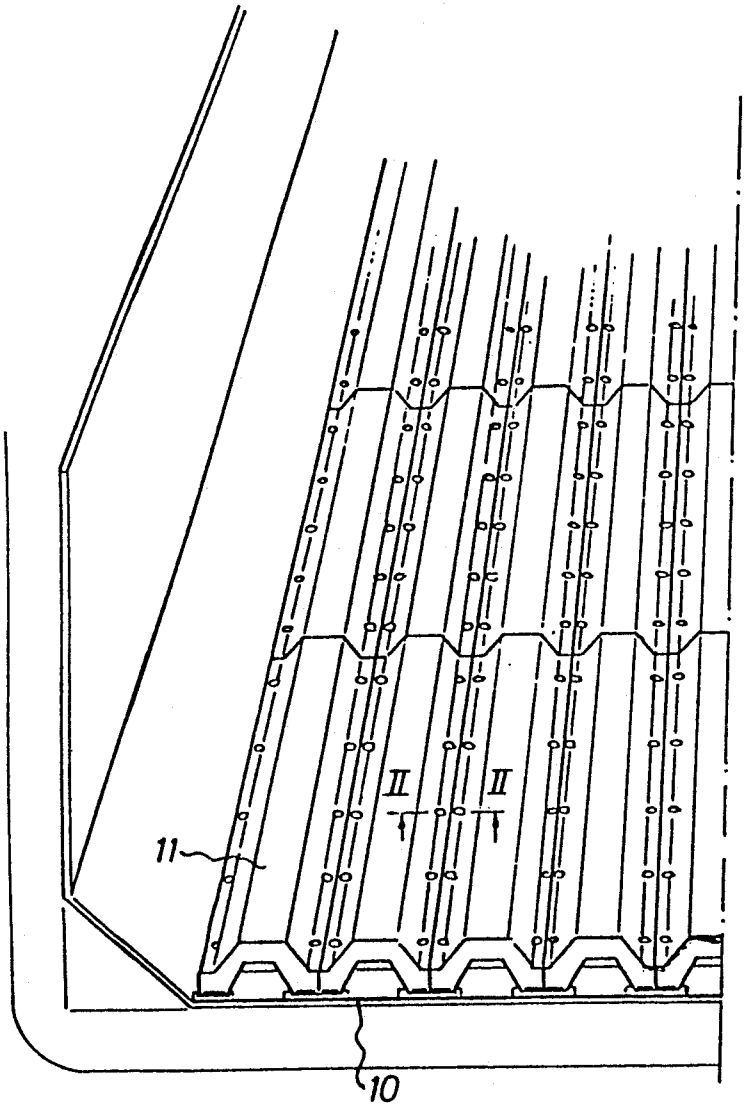
FIG. 1 is a schematic view showing a section of a corner portion of a load-bearing structure provided with a wall according to the invention.

In the embodiment shown in FIG. 1, the wall exposed to wear is the bottom surface of a loading bin or platform for stone or ore. The wall consists of a supporting structure 10 on which a number of elongate wear-resisting, impact-absorbing elements 11 are mounted side by side. Although, in this embodiment, the supporting structure is continuous, it may also consist of spaced-apart, parallel beams or a beam grating.

The design of the elements 11 appears more clearly from FIG. 3, and FIGS. 4–6.

Figure 2:
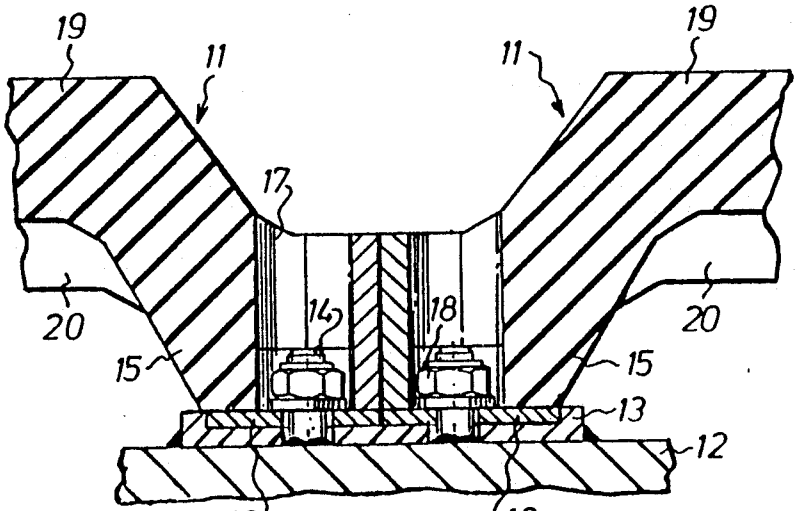
FIG. 2 is a enlarged part sectional view taken along the line II—II in FIG. 1.

As shown in FIG. 2, a supporting structure 12 is provided with a retainer element 13 welded to the supporting structure. The retainer element 13 has flanges to limit the transverse movement of the base portions 15, as illustrated in FIG. 2. Stud bolts 14, welded to the retainer element 13, serve as fixing means for the base portions 15 of the elements 11. The base portions 15 have, integrated therein by vulcanisation or curing, a stiffening and reinforcing, elongate metal member 16. Holes 17 are formed in the base portions of the elements 11 in register with the stud bolts 14 to permit screwing nuts 18 onto the bolts 14. Between adjacent base portions 15 of each element 11 extends an arch portion 19 whose underside is spaced from the supporting structure 12.

Figure 6:
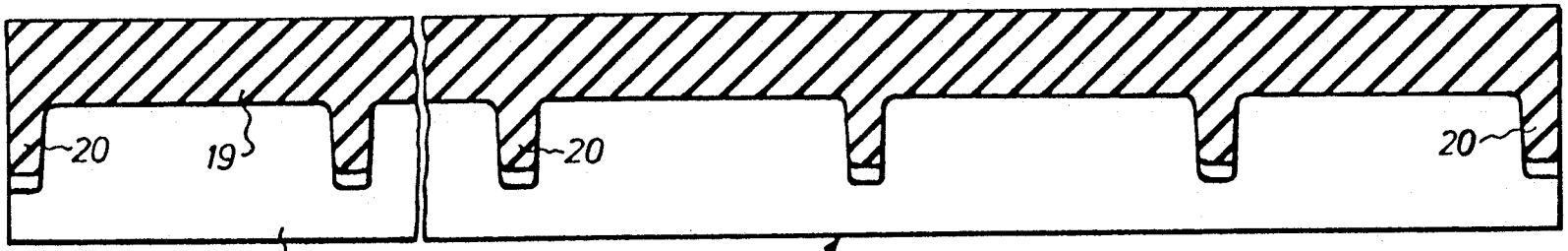
FIG. 6 is a section taken along the line VI—VI in FIG. 5.
Figure 5:
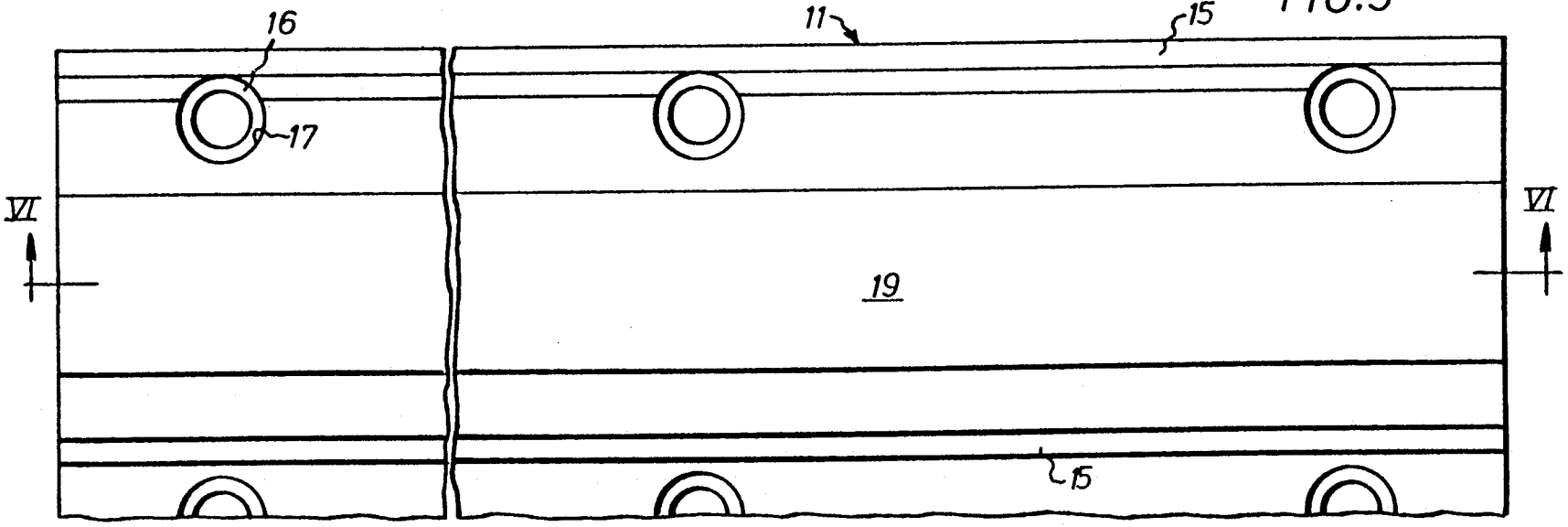
FIG. 5 is a top plan view showing parts of the element of FIG. 4.

In the embodiment of FIGS. 1–3, each element 11 has two base portions 15 and one arch portion 19 extending therebetween. In the embodiment of FIGS. 4–6, however, each element 11 has three base portions and two arch portions. Elements having one or two arch portions are preferred.

To optimise the energy absorbing ability and the wear resistance of the elements 11, it is advantageous in a preferred embodiment of the invention to design the arch portion 19 with a thickness not exceeding 50% of the total thickness of the element, counting from the underside of the base portion to the upper side of the arch portion. Moreover, in this preferred embodiment, the total thickness of the element 11 should be at least 10 cm. A preferred range of the arch portion thickness is about 30–50% of the total thickness of the element 11. This design provides for a sufficient elastic deflection (=energy-absorbing zone) between the underside of the arch portion and the bottom edge of the base portions.

In the invention, it is also preferred that the thickness of the elastomer or plastic material is substantially the same throughout the entire width of the element. The arch portion of the elastomer or plastic material thus passes into a substantially equally thick, protective layer in the base portions.

As appears from the drawings, the wear-resisting, impact-absorbing elements are preferably provided with transverse stiffening ribs 20 which are integrally formed with the arch portion or portions and the free edge of which is located within the arch portion at a certain distance from a plane (top face of supporting structure 12) defined by the base portions 15. When mounting several elongate elements after each other as shown in FIG. 1. one stiffening rib is preferably disposed at each end of the element 11. Thus, the element 11 will be reinforced in this area, thereby avoiding or minimising any unnecessary detrimental deflection in said area as a result of an impact from pieces of stone or ore on the very joint between two successive elements. As appears from FIG. 6, it is of course possible, if so desired, to arrange stiffening ribs 20 at different locations throughout the length of the elements 11. The ribs 20 should however have a small thickness in relation to the length of the elements, since they must not interfere to any considerable extent with the energy-absorbing deflection of the arch portion when subjected to impacts from pieces of ore or stone.

We claim:

1. A wall which is made up of ear resisting, impact-absorbing elements and a structure supporting said elements which form a wear-resisting, impact-absorbing layer of an elastomer or plastic material, wherein said elements are elongate in a longitudinal direction and comprise spaced-apart base portions to permit mounting said elements on said structure, said base portions being spaced-apart in a transverse direction and having a length extending in a longitudinal direction, and arch portions formed of said wear-resistant elastomer or plastic material and extending freely between said base portions, said arch portions also longitudinally extending for the longitudinal length of said base portions, and each element having at least two base portions and one arch portion between each pair of adjacent base portions.

2. Wall as claimed in claim 1, characterised in that each element has one or more transverse stiffening ribs which are integrally formed with the arch portion or portions and whose free edge is located within the arch portion at a certain distance from a plane defined by said base portions.

3. Wall as claimed in claim 1 or 2 characterised in that the wear-resisting, impact-absorbing elements have a total thickness of at least 10 cm.

4. Wall as claimed in any one of claims 1, 2 or 3, characterised in that the thickness of the arch portion amounts to 50% at most of the total thickness of the element, preferably about 30–50% of the total thickness thereof.

5. Wall as claimed in any one of claims 1 or 2, characterised in that each base portion has a stiffening or reinforcing metal member embedded in or vulcanised to the elastomer or plastic material.

6. A wall as claimed in claim 1 wherein said base portions include an upper and lower surface and said arch portions include an upper surface which is higher in height than the upper surface of said base portions.

7. A wall as claimed in claim 1 wherein said base portions each have attachment holes serially spaced along the longitudinal direction of said base portions.

8. A wall as claimed in claim 1 wherein at least two of said base portions and one of said arch portions are integrally formed of a common material so as to constitute said elements, and said elements further comprising a planar member received within a recess formed in a lower surface of each of said base portions, said planar members having a lower contact surface which is essentially co-planar with the lower surface of said base portions.

9. A wall as claimed in claim 1 wherein said structure supporting said elements further comprises a retainer element which has a planar support surface and transversely spaced apart flanges extending off of said support surface so as to limit transverse movement of a base portion.

10. A wall as claimed in claim 1 wherein said base portions each have attachment holes serially spaced along the longitudinal direction of said base portions.

11. A wall as claimed in claim 1 wherein said base portions and one of said arch portions are integrally formed of a common material so as to constitute said elements, and said elements further comprising a planar member received within a recess formed in a lower surface of each of said base portions, said planar members having a lower contact surface which is essentially co-planar with the lower surface of said base portions.

12. A wall as claimed in claim 1 wherein said structure supporting said elements further comprises a retainer element which has a planar support surface and transversely spaced apart flanges extending off of said support surface so as to limit transverse movement of a base portion.

13. A wall which is made up of wear resisting, impact-absorbing elements and a structure supporting said elements which form a wear-resisting, impact-absorbing layer of an elastomer or plastic material, wherein said elements are elongate in a longitudinal direction and comprise spaced-apart base portions to permit mounting said elements on said structure, said base portions being spaced-apart in a transverse direction and having a length extending between a first and a second end, and arch portions formed of said wear-resistant elastomer or plastic material and extending transversely between said base portions, said arch portions also longitudinally extending for the longitudinal length of said base portions, and said arch portions having a first end essentially coplanar with the first end of said base portions and a second end essentially coplanar with the second end of said base portions, and each element having at least two base portions and one arch portion between each pair of adjacent base portions, and stiffening ribs which are formed along a lower surface of said arch portion and which extend transversely between said spaced-apart base portions and which are serially spaced along the longitudinal length of said arch portion.

14. A wall as claimed in claim 13 wherein said base portions have a lower surface and said stiffening ribs are located between the lower surface of said base portions and said arch portions.

15. A wall as claimed in 13 wherein each base portion has a stiffening or reinforcing metal member embedded in or vulcanized to the elastomer or plastic material.

16. A wear-resisting, impact-absorbing wall element which includes a wear-resisting, impact-absorbing layer of an elastomer or plastic material, wherein the element is elongate in a longitudinal direction and comprises:

spaced-apart base portions to permit mounting said element, said base portions being spaced-apart in a transverse direction and having a length extending in a longitudinal direction, and an arch portion formed of said wear-resistant elastomer or plastic material and extending freely between said base portions, said arch portion also extending for the length of said base portions, said element having at least two base portions and one arch portion between each pair of adjacent base portions, and said element having one or more transverse stiffening ribs which are integrally formed with said arch portion and have a free edge which is located within the arch portion at a distance from a plane defined by said two base portions.

17. A wall element as claimed in claim 16, characterised in that the total thickness of the element is at least 10 cm.

18. A wall element as recited in claim 16, characterised in that the thickness of the arch portion amounts to about 30–50% of the total thickness thereof.

19. A wall element as recited in claim 16, characterised in that each base portion has a stiffening or reinforcing metal member embedded in or vulcanised to the elastomer or plastic material.

* * * * *